US006743073B1

(12) United States Patent
Tsai et al.

(10) Patent No.: US 6,743,073 B1
(45) Date of Patent: Jun. 1, 2004

(54) BRASSIERE PAD

(76) Inventors: Su-Hsia Tsai, No. 11, Lane 66, Huai-De Street, Peitou Dist., Taipei (TW); Shih-Heng Huang, No. 11, Lane 66, Huai-De Street, Peitou Dist., Taipei (TW)

( * ) Notice: Subject to any disclaimer, the term of this patent is extended or adjusted under 35 U.S.C. 154(b) by 0 days.

(21) Appl. No.: 10/359,580

(22) Filed: Feb. 7, 2003

(30) Foreign Application Priority Data

Dec. 25, 2002 (TW) ..... 91221109 U

(51) Int. Cl.[7] ..... A41C 3/00

(52) U.S. Cl. ..... 450/57; 2/1

(58) Field of Search ..... 450/39, 38, 1, 450/54–57, 93, 30–32; 2/267, 2, 3, 463, 465, 468, 46, 48, 50, 51, 243.1, 247; 174/35 R, 356 C, 25 MC; 361/816, 818; 250/505.1, 515.1, 516.1, 519.1

(56) References Cited

U.S. PATENT DOCUMENTS

| | | | | | |
|---|---|---|---|---|---|
| 4,471,015 | A | * | 9/1984 | Ebneth et al. | 428/403 |
| 5,073,984 | A | * | 12/1991 | Tone et al. | 2/455 |
| 5,782,671 | A | * | 7/1998 | Suen et al. | 450/38 |
| 5,833,594 | A | * | 11/1998 | Hsieh | 600/15 |
| 5,882,242 | A | * | 3/1999 | Hardy | 450/1 |
| 5,944,578 | A | * | 8/1999 | Lin | 450/57 |
| 5,950,239 | A | * | 9/1999 | Lopez | 600/15 |
| 6,332,862 | B1 | * | 12/2001 | Zandman | 600/15 |
| 6,374,643 | B2 | * | 4/2002 | Orima | 66/193 |
| 6,488,564 | B1 | * | 12/2002 | Gray | 450/57 |

* cited by examiner

*Primary Examiner*—Gloria M. Hale
(74) *Attorney, Agent, or Firm*—Troxell Law Office PLLC

(57) ABSTRACT

A brassiere pad including an inner layer made of resilient material; an outer layer made of resilient material and with a dimension corresponding to the inner layer; and a magnetic insert layer which is made of rubber and magnetic powder mixture and has a dimension smaller than the inner layer and outer layer. The magnetic insert layer is inserted into a lower portion between the inner layer and the outer layer.

5 Claims, 2 Drawing Sheets

BRASSIERE PAD

BACKGROUND OF THE INVENTION

1. Field of the Invention

The present invention is relating to a brassiere pad, especially to a pad with two resilient layers and lower position between said two resilient layers provided a magnetic insert layer which enable to prevent the breasts spread outwardly and achieve the purpose of making breasts centralized and enhanced. Furthermore, perhaps it may obtain the massage function through said magnetic layer.

2. Description of Related Art

The brassiere or so-called under dress is the closest dress for a female. If dressed properly, it could be helpful to the bodyline or figure of the wearer and make her more attractive. But, if dressed improperly, the effect is adversely. Thus, except wearer's personal factor, the shape and structure are the major factors for which must be taken into account.

In general, the breast size of Eastern women is smaller than the breast size of Western women. Therefore the brassiere pad design is the subject the designer pays attention to.

The conventional brassiere pad, such as Taiwan Patent Application No.: 85219929 titled "Brassiere Cups" in which one resilient layer made of fabrics and a non-woven polyester fiber layer then insert a knitting cloths layer between these two layers which enable to enhance the breast size in visual appeal. The another prior art is Taiwan Patent Application No: 89208721 namely "The brassiere cup with versatile resilient support mechanism" in which there is a non-woven cloth inserted between two sponge layers for support the breasts. Besides, there are several different types, such as inserting a liquid bag, magnetic stone, as well as air through apparatus. Obviously, the brassiere manufacturers consider this as an important subject could be further studied.

In fact, the function of brassiere pad, except breasts enhance, shielding, and supporting, they must provide the function to prevent the breasts spread outwardly. In other words, make the breasts centralized and enhanced. If the brassiere pad could obtain the massage function will be an extra advantage.

SUMMARY OF THE INVENTION

The crux of the present invention is to provide a brassiere pad which comprising: an inner layer made of resilient material; an outer layer made by of resilient material and dimension corresponding to said inner layer; and a magnetic insert layer which made by of rubber and magnetic powder mixture and dimensioned smaller than the inner layer and outer layer; said magnetic insert layer is inserted into the lower portion between said inner layer and said outer layer.

DETAILED DESCRIPTION OF THE PREFERRED EMBODIMENTS

Figure 1:
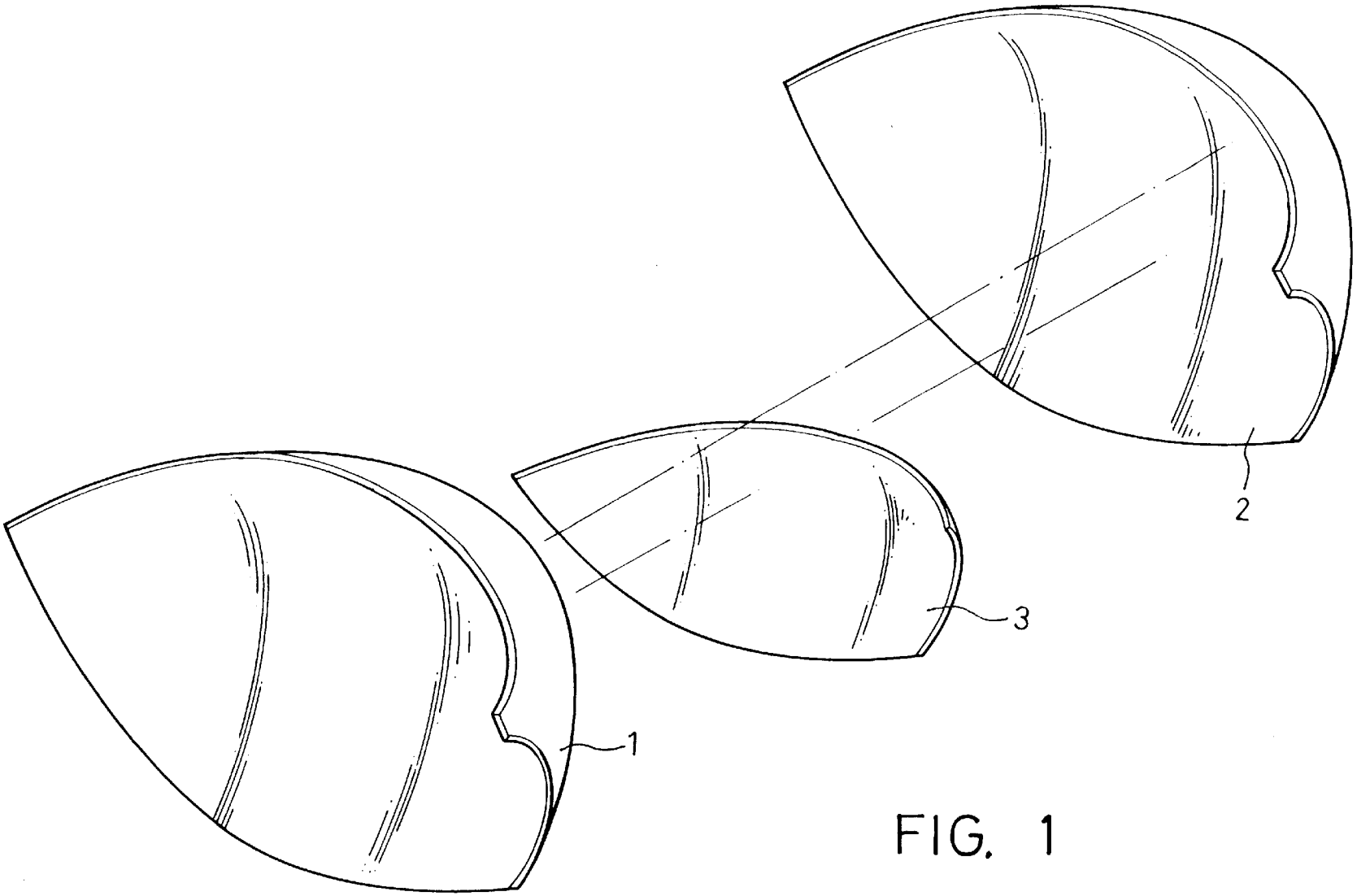
FIG. 1 is the disassemble drawing of the present invention.
Figure 2:
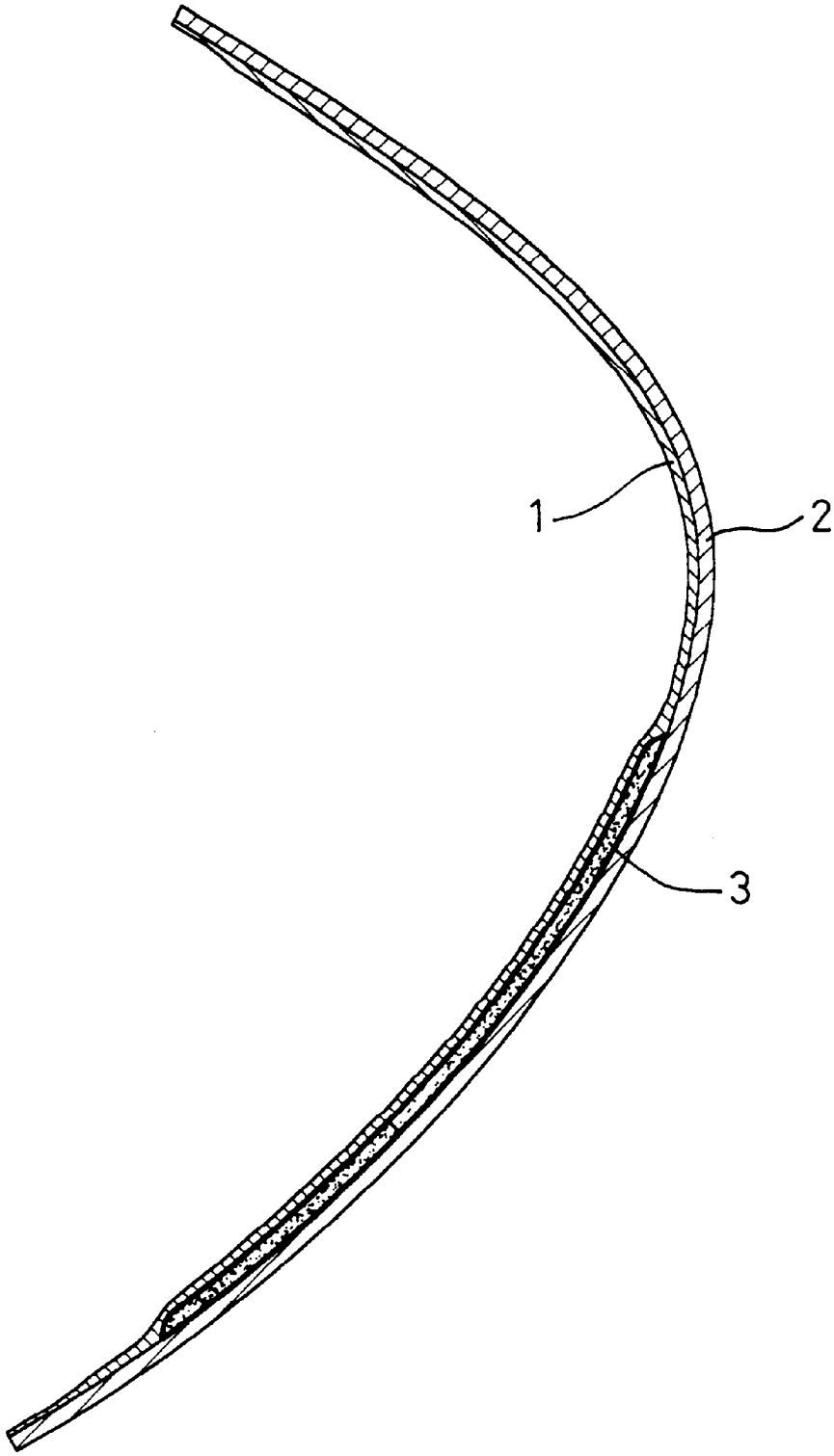
FIG. 2 is the sectional view which showing the structure of the present invention.

Refer to FIG. 1, basically, the brassiere pad of the present invention including an inner layer 1, an outer layer 2 and a magnetic insert layer 3.

The inner layer 1 and outer layer 2 are made by the soft and resilient material such as but not limited to polyester fabrics or PU sponge. The shape is corresponding to the breast's shape and as usual providing a curved space.

The feature of the brassiere pad of the present invention is the magnetic insert layer 3. Said magnetic insert layer 3 made of rubber and magnetic powder mixture and the side close to the breast is magnetical. Furthermore, said magnetic insert layer 3 is flexible and can be curled into the roll and more rigid than inner layer 1 and outer layer 2. The thickness of magnetic insert layer is at better less than 0.8 mm and the position is at the lower portion between inner layer 1 and outer layer 2. Because the magnetic insert layer 3 is more rigid than the inner layer 1 and outer layer 2, therefore, in wearing, it is not easy to be extended but supporting the breast and prevent the breast spread outwardly. By the way, the breasts can be in the central position and enhanced in visual appeal. Furthermore, through the operation of magnetic insert layer 3, it may massage the breasts.

In order to fix the configuration and position of magnetic insert layer 3, both sides of magnetic insert layer can be coated with a PU film before it is inserted into lower portion between the inner layer 1 and outer layer 2. Then, melted by mold to make those three layers combined closely.

Therefore, by the practice of the present invention, the brassiere pad is entering a new era by using magnetic material and it is the important improvement in this field.

While the invention has been described with reference to a preferred embodiment thereof, it is to be understood that modifications or variations may be easily made without departing from the spirit of this invention, which is defined by the appended claims.

What is claimed is:

1. A brassiere pad comprising: an inner layer made of resilient material; an outer layer made of resilient material and dimensioned to correspond to said inner layer; and a magnetic insert layer made of rubber and magnetic powder mixture and which is dimensioned smaller than said inner layer and outer layer; said magnetic insert layer is inserted between said inner layer and said outer layer.

2. The brassiere pad as claimed in claim 1, wherein the inner layer and the outer layer are made of same material.

3. The brassiere pad as claimed in claim 1, wherein the inner layer and the outer layer are made of sponge material.

4. The brassiere pad as claimed in claim 1, wherein a thickness of the magnetic insert layer is between 0.2 mm and 0.8 mm.

5. The brassiere pad as claimed in claim 1, wherein both sides of magnetic insert layer are coated with a layer of PU film.

* * * * *